United States Patent [19]

Duffy et al.

[11] Patent Number: 4,603,780

[45] Date of Patent: Aug. 5, 1986

[54] CARTON FOR HOUSING FRAGILE CONTAINERS

[75] Inventors: Joseph K. Duffy, Lake Forest; Mark L. Thoene, Ingleside; Cathy M. Combs, Antioch, all of Ill.

[73] Assignee: Baxter Travenol Laboratories, Inc., Deerfield, Ill.

[21] Appl. No.: 680,854

[22] Filed: Dec. 12, 1984

[51] Int. Cl.[4] ..... B65D 81/02; B65D 81/16

[52] U.S. Cl. ..... 206/591; 206/523; 206/526; 206/592; 53/436; 53/523

[58] Field of Search ..... 206/523, 524, 526, 554, 206/591, 592; 53/436, 438, 523, 526

[56] References Cited

U.S. PATENT DOCUMENTS

| | | | |
|---|---|---|---|
| 3,261,456 | 7/1966 | Sparks | 206/523 |
| 3,416,648 | 12/1968 | Levi | 206/523 |
| 3,596,754 | 8/1971 | Peterson | 206/523 |
| 3,708,946 | 1/1973 | Cahill | 206/523 |
| 4,158,266 | 6/1979 | Gilmour | 206/591 |
| 4,285,432 | 8/1981 | De Villers et al. | 206/591 |
| 4,416,376 | 11/1983 | Scheffers et al. | 206/554 |

FOREIGN PATENT DOCUMENTS

| | | | |
|---|---|---|---|
| 0869863 | 5/1971 | Canada | 206/523 |
| 2418170 | 10/1979 | France | 206/523 |

*Primary Examiner*—William Price
*Assistant Examiner*—Jimmy G. Foster
*Attorney, Agent, or Firm*—Bradford R. L. Price; Robert M. Barrett

[57] ABSTRACT

A carton for packaging fragile containers is provided. The carton includes an energy absorbing insert member, two rigid plates, and packaging. Fragile containers are located on each side of the energy absorbing insert member and the rigid plates compress the containers against the energy absorbing insert member. The packaging surrounds the energy absorbing insert, containers, and rigid plates.

15 Claims, 4 Drawing Figures

CARTON FOR HOUSING FRAGILE CONTAINERS

BACKGROUND OF THE INVENTION

This invention relates generally to cartons for housing fragile containers. In particular, this invention relates to a carton for housing frozen drug bags and the like.

Cartons for housing fragile containers are known in the art. These cartons usually comprise energy absorbing means that surround the fragile containers and some sort of packaging for surrounding the container and energy absorbing members. The energy absorbing members typically surround the fragile containers and absorb the impact force so that the impact force does not reach the containers.

In one specialized area of the medical field, frozen drugs, the construction and efficiency of the carton is especially critical. Frozen drug bags are stored at temperatures of approximately −25° C. This temperature falls below the glass transition state of certain film structures from which the frozen drug bags are constructed, e.g. polyvinyl chloride. Accordingly, these frozen drug bags are very brittle and may easily break.

The prior art frozen drug bag cartons utilize hollow cardboard inserts for absorbing the impact forces that act upon the carton. These hollow cardboard inserts surrounded the frozen drug bags when they are packaged. Although, these cartons are effective in absorbing the impact forces, the product fragility of the frozen drug bags is still approximately 1-2%.

Thus, there is a need for a carton for housing fragile containers that overcomes the disadvantages of the prior art.

SUMMARY OF THE INVENTION

The carton for fragile containers of the present invention comprises an energy absorbing insert means for absorbing impact forces to the carton. The fragile containers are located on opposite sides of the insert means by two rigid plates. The rigid plates compress the containers against the insert means. Packaging is used to surround the insert means, container, and rigid plates. The carton functions to limit the expansion of the container when the products within the container are frozen. To this end, the present invention provides a method of packaging frozen drug bags.

Preferably, the insert means is constructed so that the fragile containers are positioned in an orderly array.

Accordingly, it is an advantage of the present invention to provide a carton for housing fragile containers.

Another advantage of the present invention is that it provides a carton for housing frozen drug bags.

Moreover, an advantage of the present invention is that it provides a carton for frozen drug bags with improved product fragility.

An additional advantage of the present invention is that it provides a carton that allows the frozen drug bags to be densely packed therewithin.

Another advantage of the present invention is that it provides a carton that limits the expansion of the drug bags as they freeze.

Moreover, an advantage of the present invention is that the impact energy of perpendicular impacts to the carton is transmitted through a plate member and the frozen drug bags into an energy absorbing insert member.

A further advantage of the present carton is that it is smaller than prior art cartons.

Additional features and advantages are described in, and will be apparent from, the Detailed Description of the Presently Preferred Embodiments and from the drawings.

DETAILED DESCRIPTION OF THE PRESENTLY PREFERRED EMBODIMENTS

Figure 1:
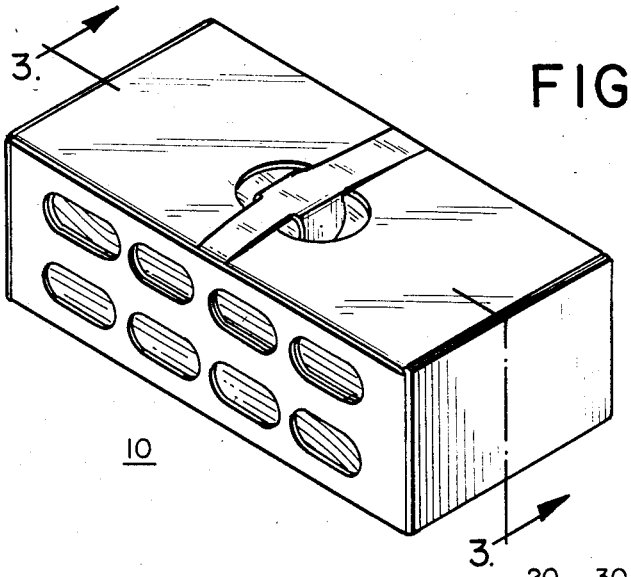
FIG. 1 illustrates a side elevational view of an embodiment of the carton of the present invention.

FIG. 1 illustrates the carton 10 of the present invention. The carton 10 is constructed so that fragile containers may be housed or packaged in the carton and protected from impact forces the carton may encounter during shipping and handling.

Figure 3:
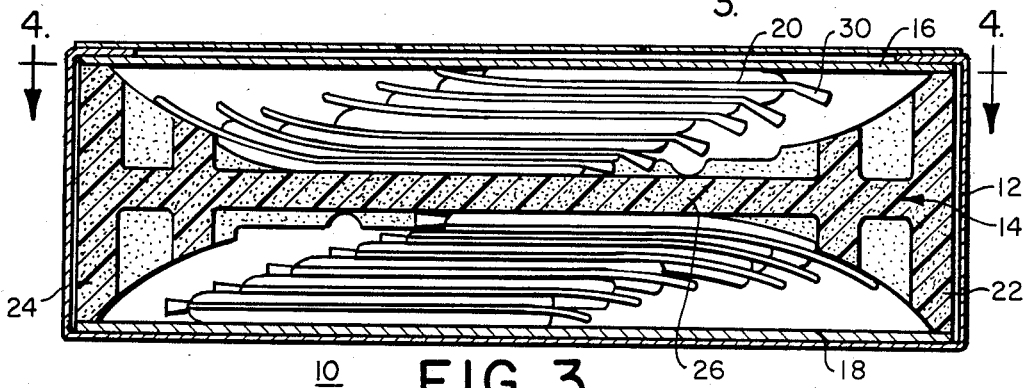
FIG. 3 illustrates a cross-sectional view of the carton of the present invention taken along lines 3—3 of FIG. 1.
Figure 4:
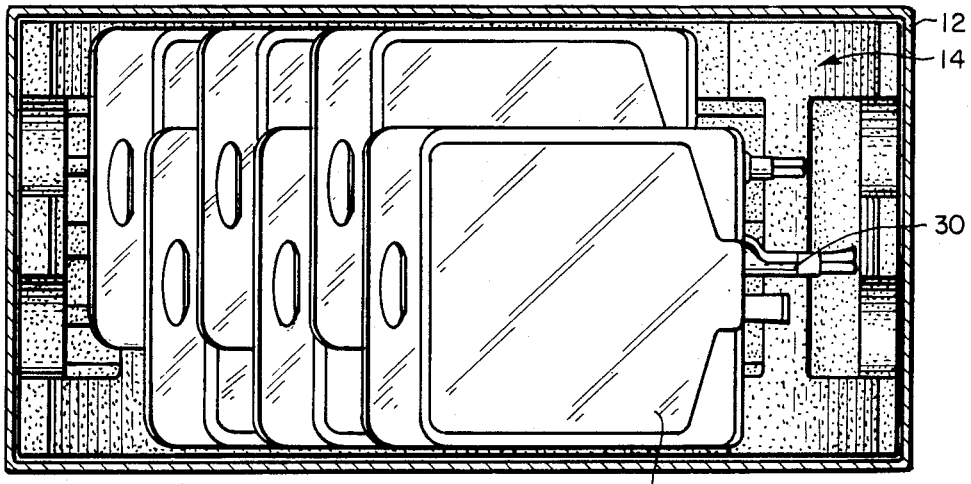
FIG. 4 illustrates a cross-sectional view of the carton of the present invention taken along lines 4—4 of FIG. 3.
Figure 2:
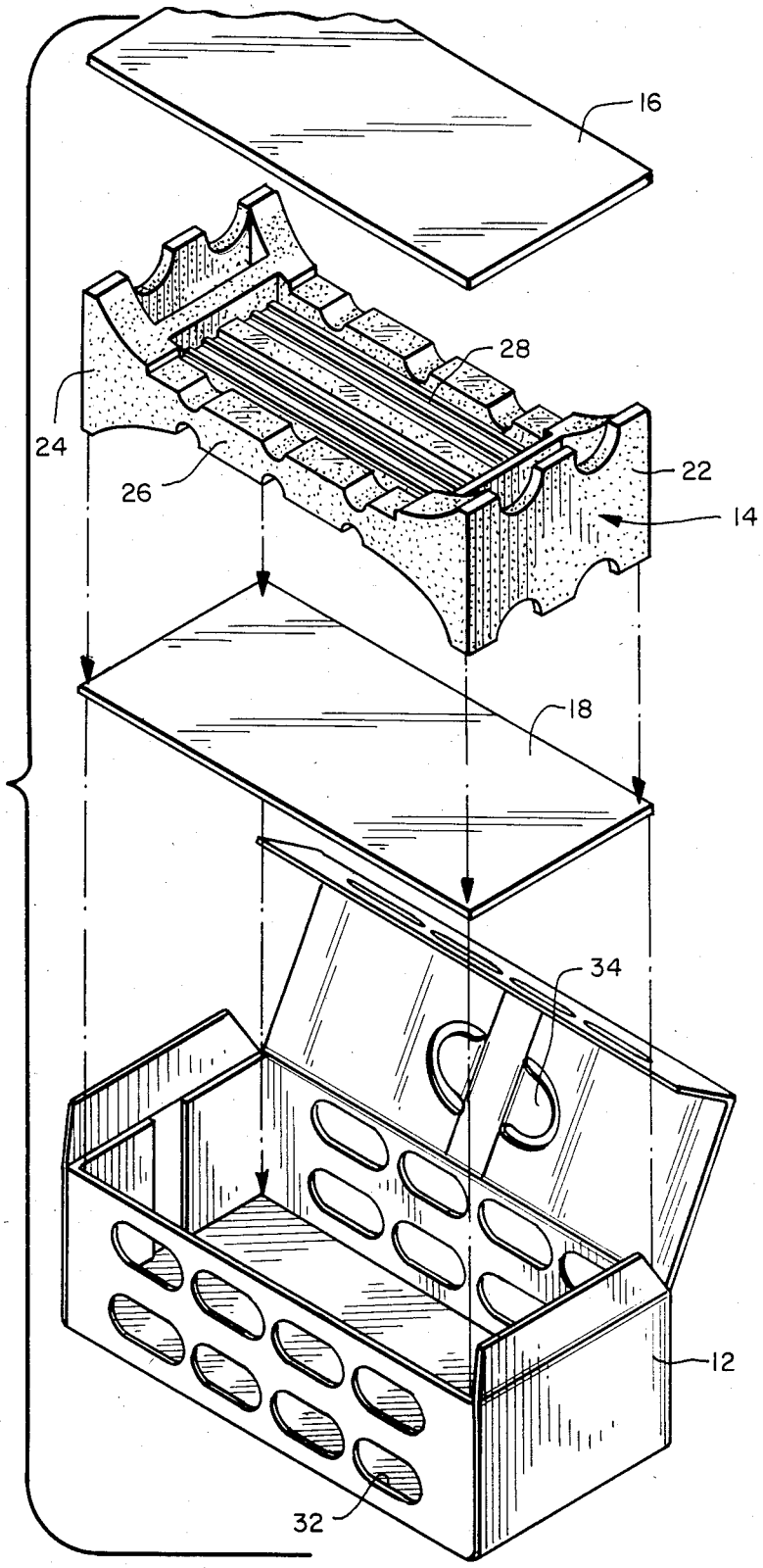
FIG. 2 illustrates an exploded view of the carton of FIG. 1 without containers.

As illustrated in FIG. 2, in a preferred embodiment, the carton 10 of the present invention comprises a package housing 12, an energy absorbing insert member 14, and two rigid plate members 16 and 18. As illustrated in FIG. 3, in use, containers 20 are located on opposite sides of the insert member 14. As described in more detail below, the rigid plate members 16 and 18 are located on top of the containers 20 on opposite sides of the insert member 14.

The energy absorbing insert member 14 is constructed so that containers 20 may be located on either side of the insert member 14. To this end, as illustrated in FIG. 3, the insert member includes end members 22 and 24 and a body member 26. The end members 22 and 24 have a cross-sectional width that is greater than the cross-sectional width of the body member 26. Although the energy absorbing insert member 14 is illustrated as having a rectangular cross-sectional shape, it should be noted that the insert member could have a different cross-sectional shape, e.g. square or oval shape.

The body member 26 includes grooves 28 for receiving ports 30 on the containers 20. The grooves 28 help to align the containers 20. To this end, the energy absorbing insert 14 is designed to support the containers 20 in a "shingle" like manner. Preferably two rows of containers are located on each side of the insert 14. When the product within the containers 20 is frozen this shingle arrangement helps to direct the energy of impact forces through the containers into the energy absorbing insert 14. Moreover, the shingle arrangement allows the containers 20 to be more densely packed.

The energy absorbing insert member 14 is constructed from a material with good energy absorbing characteristics. Preferably, the insert member 14 is constructed from a foam material, preferably expanded polystyrene.

As previously stated, the carton 10 includes rigid plates 16 and 18. The rigid plates 16 and 18 preferably have a rectangular shape that substantially covers one side of the insert member 14. The rigid plates 16 and 18 are constructed so that they compress the containers 20 against the insert member 14. To this end, the packaging housing 12 is designed to secure the plates 16 and 18 around the insert member 14 forcing the containers 20 against the insert member 14.

The plates 16 and 18 are constructed from a substantially rigid material. Preferably, the plate members 16 and 18 are constructed from metal, plastic, rigid cardboard, or rigid paperboard. Nonbending chip board having a thickness of 0.088 inch sold by Olympic Packaging of Mundelein, Ill. has been found to function satisfactorily as the rigid plate 16 or 18.

The rigid plates 16 and 18 function to drive the impact force through the frozen containers 20 into the energy absorbing insert member 14. This is in contrast to prior packaging methods that cushion the fragile container on all sides in an attempt to dissipate the impact energy before it reaches the fragile container. Moreover, the rigid plates 16 and 18 function to compress the containers 20 against the insert 14 thereby limiting the expansion of the containers when they are frozen. The rigid members 16 and 18 and insert member 14 also cooperate to limit the movement of the containers 20 within the carton 10.

Referring back to FIG. 1, the package housing 12 is illustrated. The package housing 12 is designed to secure the rigid plates 16 and 18 against the containers 20 and insert 14. As illustrated, the package housing 12 is constructed so that it is easily wrapped around the rigid plates 16 and 18, containers 20, and energy absorbing insert member 14 and secured together to create the carton 10. The package housing 12 includes openings 32 to allow air flow in and out of the container 10. The package housing 12 may also include a handle 34. Preferably the package housing 12 is constructed from cardboard or some other light weight inexpensive material with sufficient strength.

In use, the containers 20 are located on the insert member 14 between the rigid plates 16 and 18. The package housing 12 is secured around the rigid plates 16 and 18, and the insert member 14 so that the rigid plates 16 and 18 compress the containers 20 against the insert member 14.

This construction is particularly advantageous if the carton 10 is used to house frozen drug bags. Typically the drug bags are packaged within the carton 10 and then the bags are frozen. Because of the compression force of the rigid plates 16 and 18, the expansion of the frozen drug bags is limited. Accordingly, "peaks and valleys" that are sometimes present in prior art cartons for frozen drug bags are eliminated. Moreover, the carton 10 of the present invention is 33% smaller than the prior art frozen drug carton.

It has been found that the carton 10 constructed in accordance with the present invention has a better product fragility than the prior art cartons. Laboratory drop and shake testing and a one-hour ASTM road hazard test (shake), were performed on a prior art frozen drug carton and the carton 10 of the present invention. Each carton contained frozen drug bags. The product (frozen drug bag) fragility of the prior art carton was 1% to 2%. The product (frozen drug bag) fragility of the carton of this invention was 0.34%.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A carton for fragile frozen product containers comprising:

energy absorbing insert means for absorbing impact forces to the carton, the fragile frozen product containers being located on opposite sides of the energy absorbing insert means;

two rigid plates located on opposite sides of the energy absorbing insert means for compressing the frozen product containers against the energy absorbing insert means; and packaging means for surrounding the energy absorbing insert means, the frozen product containers, and rigid plates, and forcing the rigid plates against the frozen product containers towards the energy absorbing insert means.

2. The carton of claim 1 wherein the energy absorbing insert means includes means for orienting the fragile containers in an orderly array to limit movement of the containers.

3. The carton of claim 1 wherein the rigid plates and energy absorbing insert means cooperate to limit the expansion of the frozen product containers as the product freezes.

4. The carton of claim 1 wherein the energy absorbing insert means includes means for limiting the movement of the frozen product containers within the carton.

5. The carton of claim 4 wherein the energy absorbing insert means includes end members and a body member therebetween, the end members having a greater cross-sectional width than the body member.

6. The carton of claim 1 wherein the packaging means includes openings for providing air flow into the carton.

7. A carton for housing frozen drug bags comprising:

energy absorbing insert means for absorbing impact forces to the carton, the frozen drug bags being located on opposite sides of the energy absorbing insert means;

two rigid plates located on opposite sides of the energy absorbing insert means and compressing the frozen drug bags against the energy absorbing insert means and cooperating with the energy absorbing insert means to limit the expansion of the frozen drug bags as the drug freezes and to limit the movement of the drug bags within the carton; and packaging means for surrounding the energy absorbing insert means, drug bags, and rigid plates, and compressing the rigid plates against the drug bags.

8. The carton of claim 7 wherein the energy absorbing insert means includes means for orienting the frozen drug bags in an orderly array to limit movement of the containers.

9. The carton of claim 8 wherein the means for orienting includes grooves for receiving ports on the frozen drug bags.

10. The carton of claim 7 wherein the packaging means includes openings for providing air flow into the carton.

11. A method for packaging frozen drug bags comprising the steps of:

locating a plurality of drug bags on opposite sides of an energy absorbing insert;

locating a rigid plate over the drug bags on opposite sides of the drug bags;

compressing the rigid plates towards the energy absorbing insert;

securing the rigid plates around the energy absorbing insert with packaging; and freezing the drug bags.

12. The method of claim 11 including the step of limiting the expansion of the drug bag as it freezes.

13. The method of claim 11 including the step of orienting the drug bags to limit the movement.

14. A carton for fragile product containers comprising:

energy absorbing insert means for absorbing impact forces to the carton, the fragile frozen product containers being located on opposite sides of the energy absorbing insert means;

energy transmission means comprising two rigid plates located on opposite sides of the energy absorbing insert means, said energy transmission means compressing the frozen product containers against the energy absorbing insert means and driving any impact forces on said rigid plates through the frozen product containers; and packaging means for surrounding the energy absorbing insert means, the frozen product containers and the energy transmission means, and forcing said energy transmission means against the frozen product containers toward the energy absorbing insert means.

15. The carton of claim 14, wherein said rigid plates and said energy absorbing insert means cooperate to limit the expansion of the frozen product containers as the frozen product freezes and to limit the movement of the frozen product containers within said carton.

* * * * *